US005337685A

United States Patent [19]

Badillo

[11] Patent Number: 5,337,685

[45] Date of Patent: Aug. 16, 1994

[54] EXPANSION KIT FOR PROGRAMMABLE SEWING MACHINE

[75] Inventor: Paul Badillo, Littleton, Colo.

[73] Assignee: Ralph's Industrial Sewing Machine Company, Denver, Colo.

[21] Appl. No.: 85,280

[22] Filed: Jun. 29, 1993

[51] Int. Cl.[5] ..... D05B 21/00

[52] U.S. Cl. ..... 112/121.15; 200/61.58 R; 269/73

[58] Field of Search ..... 112/121.12, 121.15; 269/73; 33/1 M, 503, 568, 289 R; 248/913; 200/18, 52 R, 61.58 R, 61.41, 61.42

[56] References Cited

U.S. PATENT DOCUMENTS 4,444,135 4/1984 Yanagi et al. ..... 112/121.12

OTHER PUBLICATIONS

Compact Type 1-Needle Lockstitch Computer Control Cycle Machine Parts List, Juki Corporation Publication Date Unknown.

*Primary Examiner*—Clifford D. Crowder

*Assistant Examiner*—Paul C. Lewis

*Attorney, Agent, or Firm*—Sheridan Ross & McIntosh

[57] ABSTRACT

An apparatus for increasing the range of movement of a clamp assembly of a sewing machine in two directions, one being opposite the other. The apparatus generally comprises a first tripping member interconnected and movable with the clamp assembly of the sewing machine and having a first tripping portion which is engageable with a first limit switch of the sewing machine. A second tripping member is interconnected with the first tripping member and has a second tripping portion which is engageable with the second limit switch. Generally, the second tripping member is movable relative to the first tripping member between first and second positions. The first position corresponds with the second tripping portion being positioned within a tripping zone for tripping the second limit switch, and the second position corresponds with the second tripping portion being positioned out of the tripping zone such that the first and not the second tripping member will trip the first limit switch.

23 Claims, 7 Drawing Sheets

EXPANSION KIT FOR PROGRAMMABLE SEWING MACHINE

FIELD OF THE INVENTION

The present invention generally relates to the field of programmable sewing machines and, more particularly, to a tripping assembly for a programmable sewing machine which expands the normal range of travel of the machine's clamp assembly.

BACKGROUND OF THE INVENTION

Programmable sewing machines are known in the art of textile manufacturing to perform certain repetitive stitching functions in the manufacturing process. Programmable sewing machines are useful for repetitive stitching operations since numerous sewing patterns may be stored in a computer memory and subsequently accessed by an operator. Such sewing patterns can be used to produce a desired stitching design on the given material, namely by moving the material relative to the sewing needle with a clamp assembly (i.e., an arch clamp and a lower clamp plate which may be moved in both in the "X" and "Y" directions) which appropriately engages and moves the material relative to a sewing needle.

Programmable sewing machines, namely the clamp assembly, typically have a maximum range of motion in the "X" direction which is defined by the spacing between two limit switches on the machine. For example, when the limit switch spacing is two inches, the maximum range of motion of the clamp assembly is two inches. However, models are available with various ranges of motion such as a 2-inch, 4-inch, and 6-inch range. Regardless of the spacing, the limit switches are tripped in one commercially available machine by a one-piece tripping plate which is interconnected with the clamp assembly. When the clamp assembly is moving in one direction and the tripping plate trips a limit switch, the clamp assembly will be prevented from further movement in that direction. Similarly, the other limit switch limits movement of the clamp assembly in the opposite direction when tripped by the one-piece tripping plate.

In some instances, it may be desirable for the operator of a programmable sewing machine to obtain a range of motion of the clamp assembly which is slightly more than the maximum range of motion, without purchasing an upgraded and more expensive model with increased range capacity. Prior to the present invention, in one commercially available machine it was not possible to modify the machine to obtain a range of motion of the clamp assembly greater than the maximum range of motion of the machine without extensive modifications to the internal structure of the machine and which typically involved replacing pertinent components with "larger" components (e.g., widening the spacing of the limit switches and replacing the one-piece tripping plate with a larger one-piece tripping plate). Moreover, in some cases the expansion of the range of motion was only in one direction.

Accordingly, it is an object of the present invention to provide a means for extending the range of motion of the clamp assembly which does not require significant modification of the machine. It is a related object of the present invention to provide a two-piece tripping plate assembly that replaces an existing one-piece tripping plate of a programmable sewing machine to expand the range of motion of its clamp assembly, preferably in both directions.

SUMMARY OF THE INVENTION

The present invention is embodied in a sewing machine for stitching a pattern on a stitchable material. The sewing machine generally comprises a clamp assembly for engaging the stitchable material, a movable table for moving the clamp assembly along an axis (e.g., the "X" axis) in both first and second directions, the first direction being opposite the second direction, first and second limit switches mounted on the sewing machine for limiting the range of movement of the clamp assembly in the first and second directions, respectively, and a tripping assembly interconnected and movable with the clamp assembly and comprising first and second tripping members movable relative to each other for tripping the first and second limit switches, respectively.

During sewing operations, and typically during at least a portion of the movement of the clamp assembly in the first direction, a tripping portion of the second tripping member extends beyond a tripping portion of the first tripping member in the first direction. A moving assembly is provided for moving the second tripping member relative to the first tripping member, before the tripping portion of the second tripping member reaches the first limit switch, and typically as the clamp and tripping assemblies move in the first direction, to thereby prevent the second tripping member from tripping the first limit switch. By moving the second tripping member in this manner, the first tripping member is able to trip the first limit switch at the desired time and thereby terminate movement of the clamp assembly in the first direction. Before the tripping portion of the first tripping member reaches the second limit switch by movement of the clamp assembly in the second direction, and typically as the clamp assembly is moving in the second direction, the moving assembly moves the second tripping member relative to the first tripping member such that the second tripping member, and not the first tripping member, is able to trip the second limit switch to terminate movement of the clamp assembly in the second direction.

The second tripping member is movable between two positions to allow the first tripping member to trip the first limit switch and to allow the second tripping member to trip the second limit switch. In this regard, when the second tripping member is tripping the second limit switch during movement of the clamp assembly in the second direction, the second tripping member is in a first position relative to the first tripping member. In one embodiment, such first position corresponds with a tripping portion of the second tripping member extending axially beyond a tripping portion of the first tripping member in the first direction. In this case, the second tripping member may be biased in this first position by a biasing spring which interconnects the first and second tripping members. Correspondingly, when the first tripping member is tripping the first limit switch during movement of the clamping assembly in the first direction, the second tripping member is in a second position relative to the first tripping member. In one embodiment, such second position corresponds with the tripping portion of the first tripping member extending axially beyond the tripping portion of the second tripping member in the first direction.

The movement of the second tripping member relative to the first tripping member allows for the tripping of the two limit switches in the above-described manner. In one embodiment, the moving assembly which provides this movement comprises an engaging portion of the second member which engages a portion of the sewing machine during at least a portion of the movement of the clamp and tripping assemblies in the first direction. The engaging portion of the second tripping member extends axially in the first direction and is positioned such that it is misaligned with and thus is unable to trip either of the limit switches. The engagement of the engaging portion in the above-described manner thus inhibits movement of the second tripping member in the first direction while the first tripping member continues to move with the clamp assembly in the first direction. Such movement of the first tripping member continues until the first tripping member trips the first limit switch. During movement of the clamp assembly in the second direction, the engaging portion becomes disengaged with the sewing machine and the second tripping member returns to its first position for tripping the second limit switch. This return to the first position may be provided by the above-described biasing spring.

DETAILED DESCRIPTION

Figure 1:
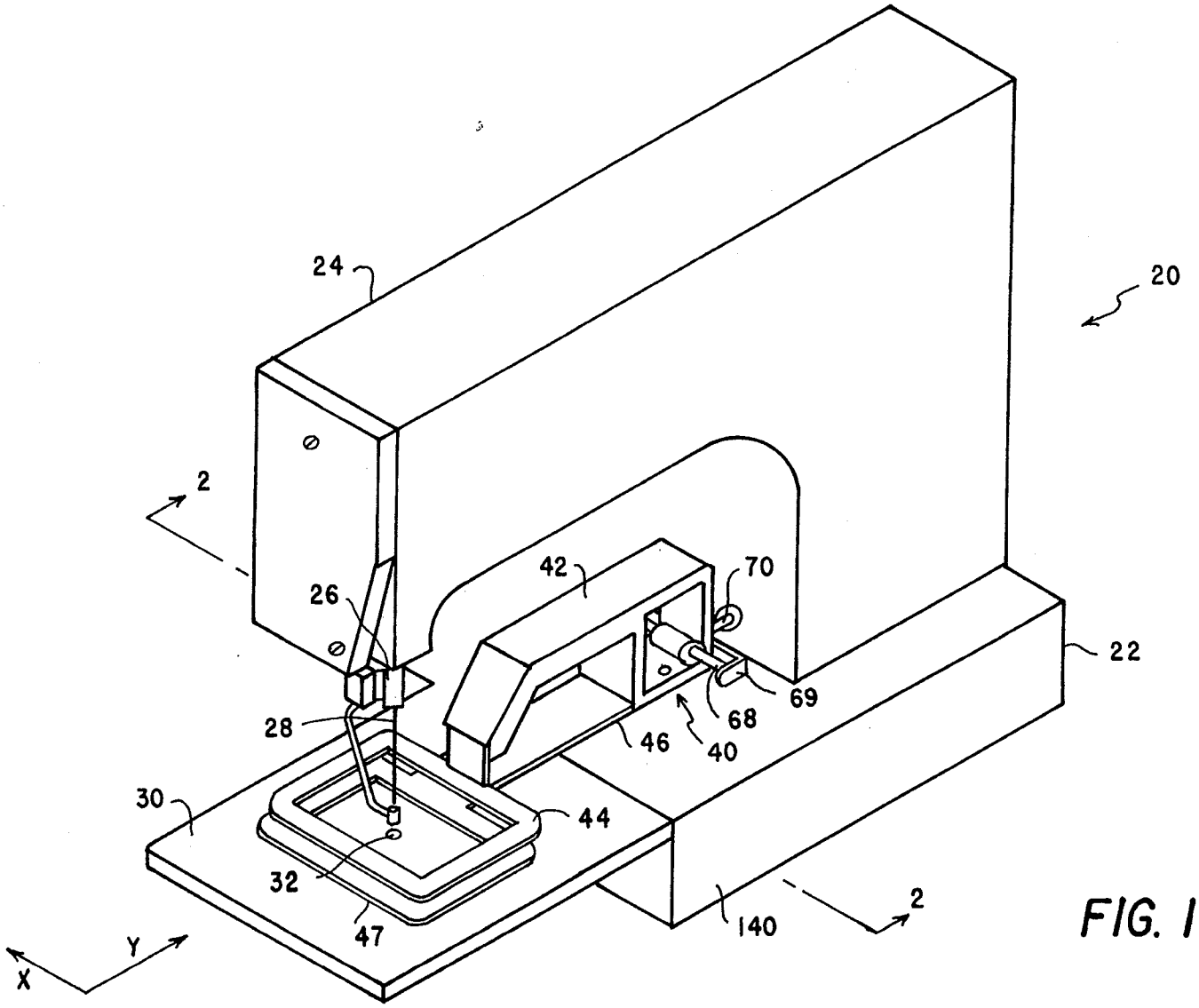
FIG. 1 is a perspective view of a programmable sewing machine.

The present invention will be described with reference to the attached drawings which illustrate the pertinent features thereof. FIG. 1 illustrates a typical electronic programmable sewing machine 20 which can utilize the present invention. Generally, the programmable sewing machine 20 includes a base 22 which supports the machine 20, a head 24 which contains many of the components of the sewing drive assembly (not illustrated) which reciprocate the needle bar 26 and thus the sewing needle 28 in the desired manner, and a cylinder bed 30 which has a needle hole 32 therein for receiving the reciprocating sewing needle 28 to work in conjunction with other sewing components contained therein. The base 22 further contains components which provide lateral movement to a clamp assembly 40. The clamp assembly 40 typically includes an arch clamp 42, to which is detachably connected an upper square clamp 44 as is known in the art, and a lower clamp plate 46 to which is connected to a lower square clamp 47. Both the arch clamp 42 and lower clamp plate 46 are detachably connected to an x-y table assembly 50 which is contained within the casting of the sewing machine 20.

Figure 2:
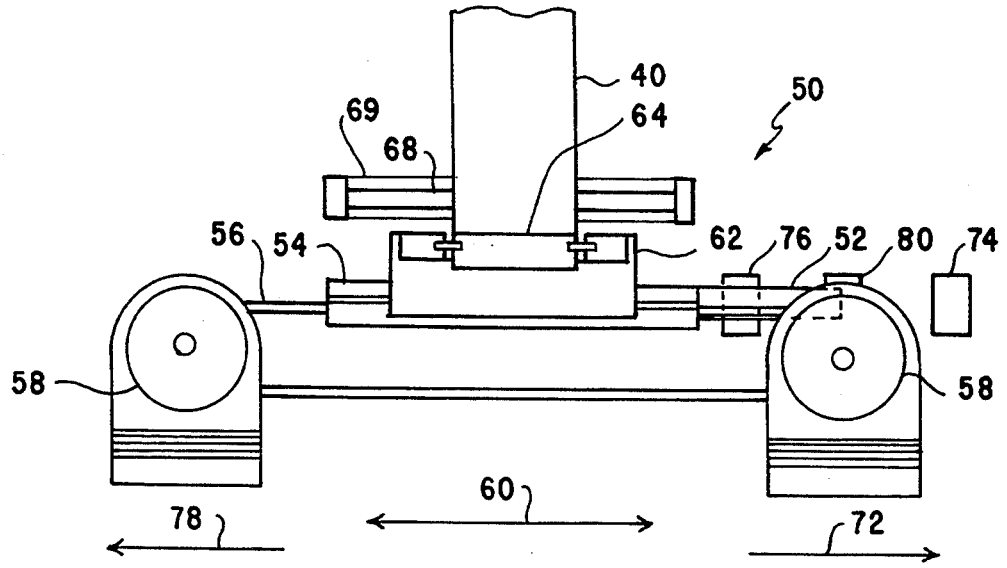
FIG. 2 PRIOR ART
FIG. 2 is a front sectional view taken along line 2—2 of FIG. 1 showing an x-y table assembly with a prior art tripping plate.
Figure 3:
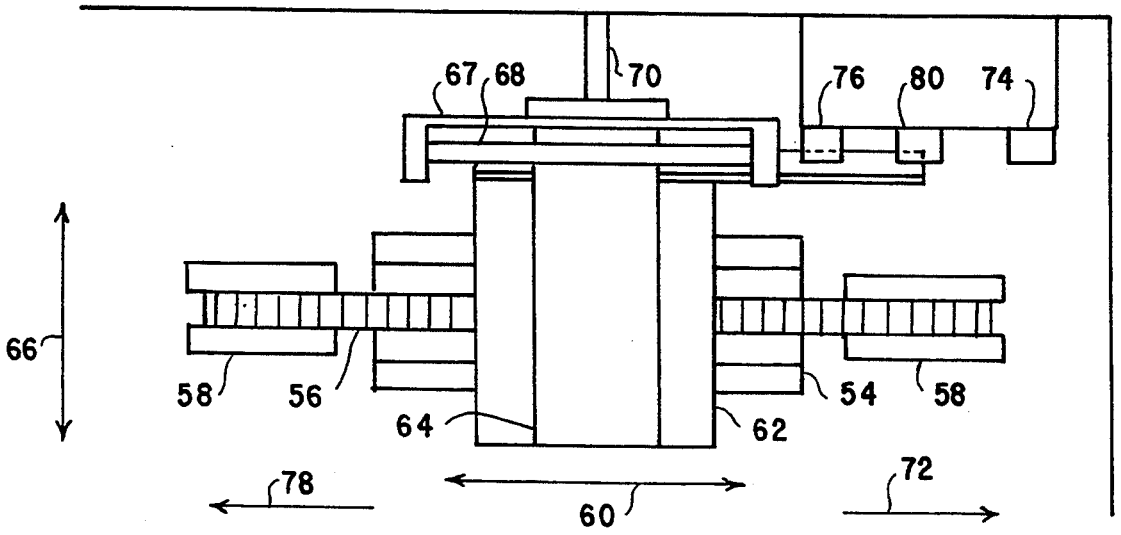
FIG. 3 PRIOR ART
FIG. 3 is a top view of the x-y table assembly of FIG. 2.
Figure 3A:
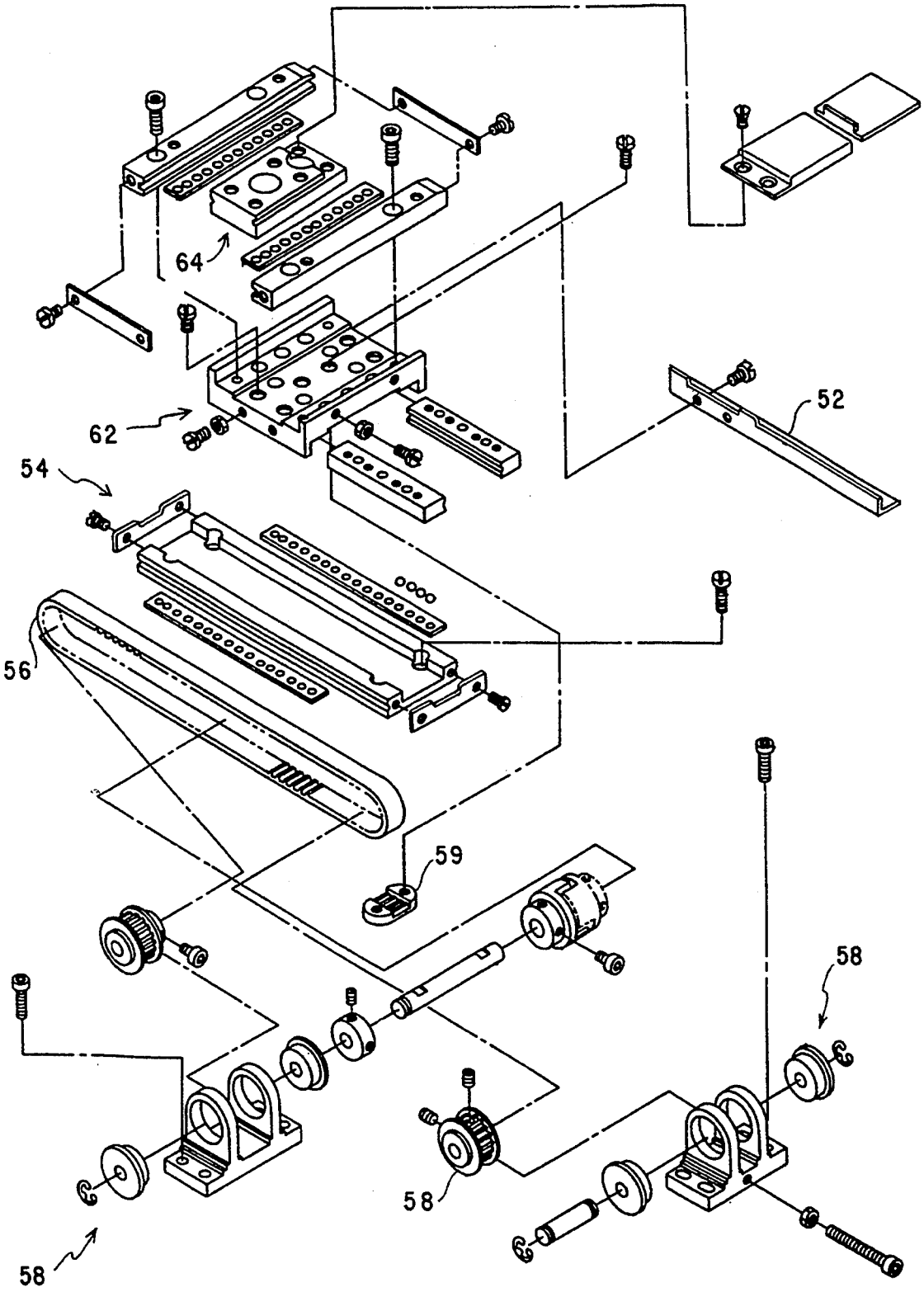
FIG. 3a PRIOR ART
FIG. 3*a* is an exploded perspective view of the x-y table assembly of FIG. 2 with the prior art tripping plate.

In FIGS. 2–3*a*, there is shown an x-y table assembly 50 of a programmable sewing machine 20 utilizing a prior art tripping plate 52. The x-y table assembly 50 generally includes a fixed race 54 above which is positioned a timing belt 56 supported on either end by sprocket wheels 58. At least one of the sprocket wheels 58 is selectably rotatable to provide movement of the timing belt 56 over the fixed race 54 along the x axis 60. A race table 62 is slidably positioned within the fixed race 54 such that the race table 62 can move along the x axis 60 relative to the fixed race 54 by movement of the timing belt 56. In this regard, the race table 62 is connected to the timing belt 56 by a connector 59 such that movement of the timing belt 56 provides movement to the race table 62 along the x axis 60.

A mounting table 64 is slidably positioned on the race table 62 such that the mounting table 64 can move along the y axis 66 relative to the race table 62. The clamp assembly 40 is detachably connected to the mounting table 64 and is further slidably mounted on an x-rod 68 such that the clamp assembly 40 can move along the x axis 60 relative to the x-rod 68. The x-rod 68 is rigidly mounted to a yoke 69 which is secured to a y-rod 70 which is selectably moveable along the y axis 66 to move the x-rod 68 and clamp assembly 40 in the y direction. Consequently, it can be appreciated that by selective movement of the y-rod 70 and the timing belt 56, the clamp assembly 40 can be moved along the x and y axes 60, 66 to properly position a piece of material relative to the sewing needle 28 for sewing a preselected pattern on the material.

The x-y table assembly 50 is further provided with a tripping plate 52 rigidly mounted on the race table 62 and extending in the positive x direction 72. First and second limit switches 74, 76 are positioned on the sewing machine 20 such that, when the clamp assembly 40 is in its normal range of motion, the first limit switch 74 is normally-open and the second limit switch 76 is normally-closed by the tripping plate 52. The limit switches 74, 76 are further operatively connected to a control mechanism (not shown) of the sewing machine 20 such that the range of movement of the clamp assembly 40 along the x axis 60 is limited by the interaction between the tripping plate 52 and the limit switches 74, 76. That is, the clamp assembly 40 cannot move in the positive x direction 72 beyond the point where the tripping plate 52 trips (closes) the first limit switch 74 and cannot move in the negative x direction 78 beyond the point where the tripping plate 52 trips (opens) the second limit switch 76. A third limit switch 80 can be used to center the clamp assembly 40 relative to the first and second limit switches 74, 76. From the above description, it can be appreciated that the range of movement of the clamp assembly 40 along the x axis 60 is limited to the spacing between the first and second limit switches 74, 76.

Figure 7:
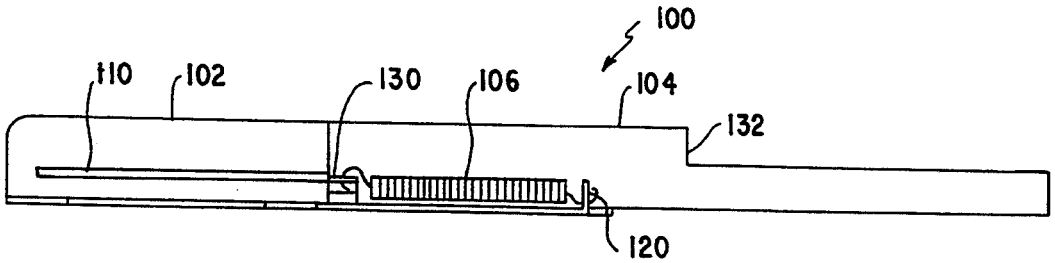
FIG. 7 is a top view of the tripping assembly of the present invention.
Figure 8:
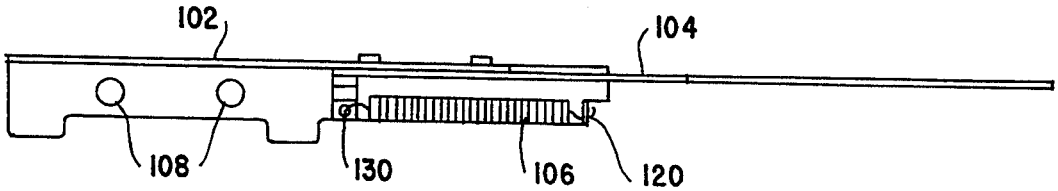
FIG. 8 is a front view of the tripping assembly of the present invention.
Figure 9:
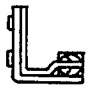
FIG. 9 is an end view of the tripping assembly of the present invention.

Referring now to FIGS. 4–9, the tripping assembly 100 of the present invention replaces the tripping plate 52 of FIGS. 2–3*a*. The tripping assembly 100 includes a first tripping member 102 mountable on the race table 62 in a manner similar to the tripping plate 52 of the prior art, and a second tripping member 104 which is slidably connected to the first member 102. A spring 106 is attached between the first and second members 102, 104 to bias the second member 104 in a fully-extended position relative to the first member 102, as shown in FIGS. 4*a*, 7, and 8.

Figure 5:
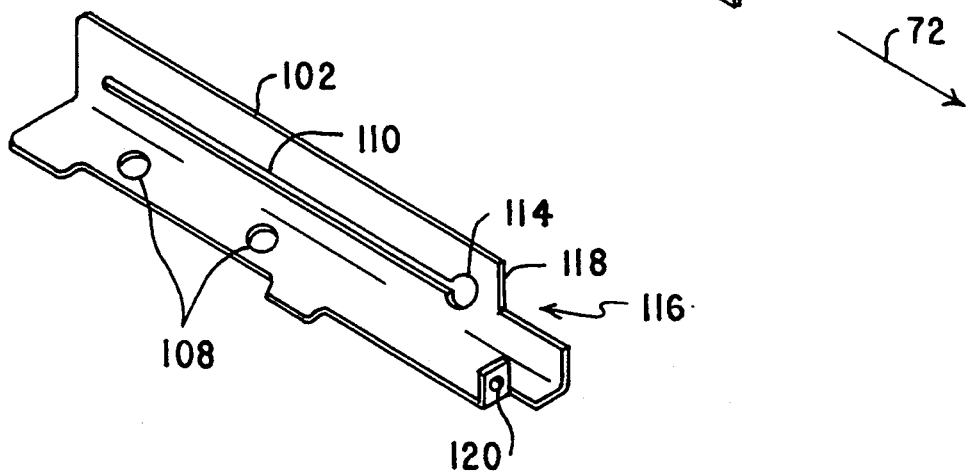
FIG. 5 is a perspective view of the first tripping member of the tripping assembly of the present invention.

As is best shown in FIG. 5, the first member 102 is a longitudinally-extending L-shaped member having two mounting holes 108 through which two mounting screws (not shown) are inserted for securing the first member 102 to the race table 62. One longitudinally-extending slot 110 is provided in the first member 102 for slidably receiving two pegs 112 on the second member 104. A slot hole 114 is positioned on the ends of the slot 110 so that the pegs 112 on the second member 104 can be initially inserted into the slot 110. A notch 116 in the first member 102 defines a first tripping edge or portion 118 and is provided to increase movement of the clamp assembly 40 in the positive x direction 72, as is explained herein in more detail. A first spring mount 120 is positioned on the first member 102 for mounting one end of the spring 106 thereto.

Figure 4A:
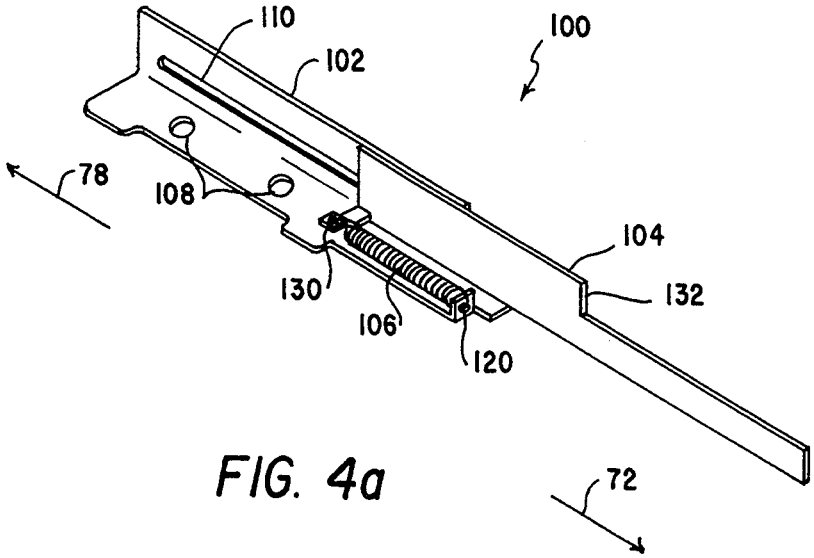
FIG. 4*a* is a perspective view of the tripping assembly of the present invention with the second tripping member in a first position relative to the first tripping member.
Figure 4B:
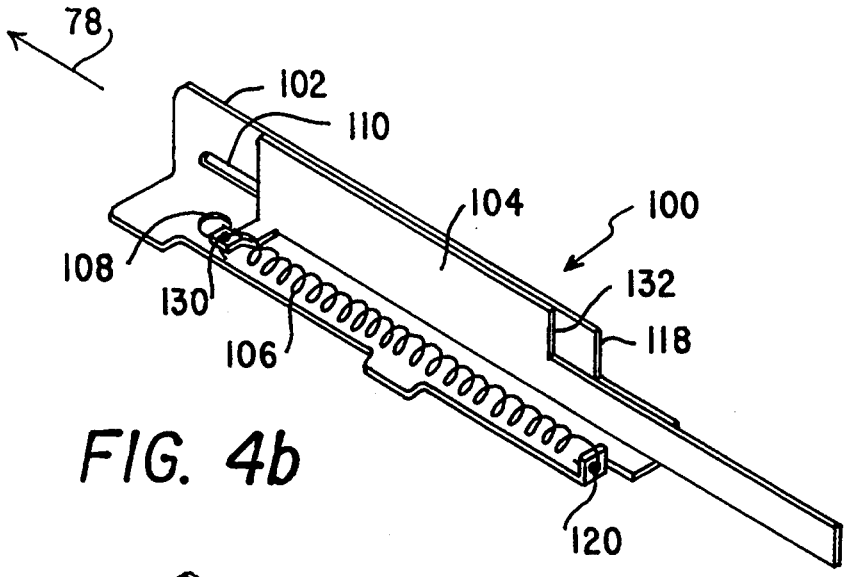
FIG. 4*b* is the perspective view of FIG. 4*a* with the second tripping member in a second position relative to the first tripping member.
Figure 6:
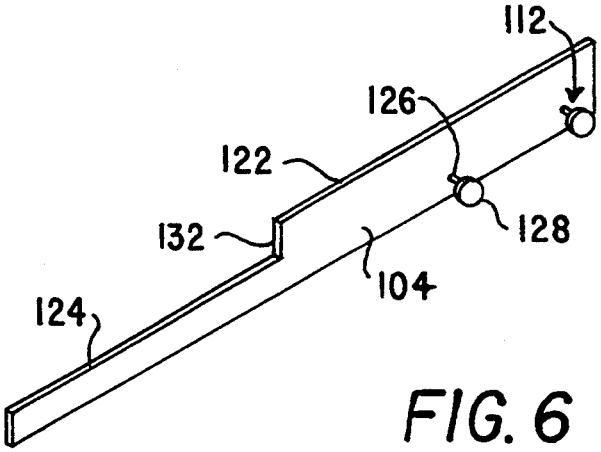
FIG. 6 is a perspective view of the second tripping member of the tripping assembly of the present invention.

Referring now to FIG. 6, the second member 104 of the tripping assembly 100 generally includes a body portion 122 and an extending portion 124. Two pegs 112 extend from the side of the body portion 122 and are positioned such that they can be inserted into the slot hole 114 of the first member 102, as noted above. The pegs 112 include a cylindrical shaft portion 126 of a diameter slightly smaller than the width of the slot 110, and a head portion 128 of a diameter larger than the width of the slot 110 to prevent the pegs 112 from becoming disengaged from the slot 110. The head portions 128 are further slightly smaller than the slot hole 114 of the first member 102 to facilitate assembly of the first and second members 102, 104, as described below. Referring to FIGS. 4*a* and 4*b*, a second spring mount 130 is provided for mounting the other end of the spring 106. The extending portion 124 is narrower than the body portion 122, thus defining a second tripping edge or portion 132 for increasing movement of the clamp assembly 40 in the negative x direction 78, as explained herein in more detail.

When the pegs 112 of the second member 104 are properly positioned in the slot 110 of the first member 102 and the spring 106 is attached to the first and second spring mounts 120, 130, an assembly is provided in which the second member 104 is biased in a first position wherein the second tripping edge 132 extends beyond the first tripping edge 118 in the positive x direction 72, as shown in FIG. 4*a*. Accordingly, it can be said that the second tripping edge 132 occupies a "tripping zone" generally corresponding to the area extending from the first tripping edge 118 in the positive x direction 72. Furthermore, the second member 104 can be slid in the negative x direction 78 relative to the first member 102 to a second position whereby the first tripping edge 118 extends beyond the second tripping edge 132 in the positive x direction 72, as shown in FIG. 4*b*. In this second position, the second tripping edge 132 does not occupy the tripping zone as defined above.

Figure 10A:
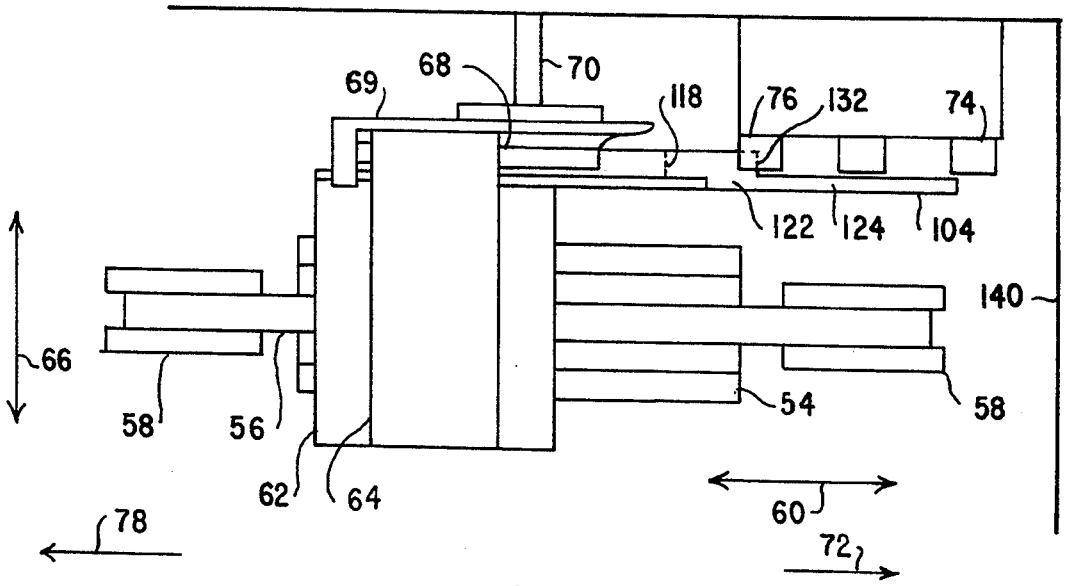
FIG. 10*a* is a top view of the x-y table assembly utilizing the tripping assembly of the present invention with the second tripping member tripping the second limit switch of the sewing machine.
Figure 10B:
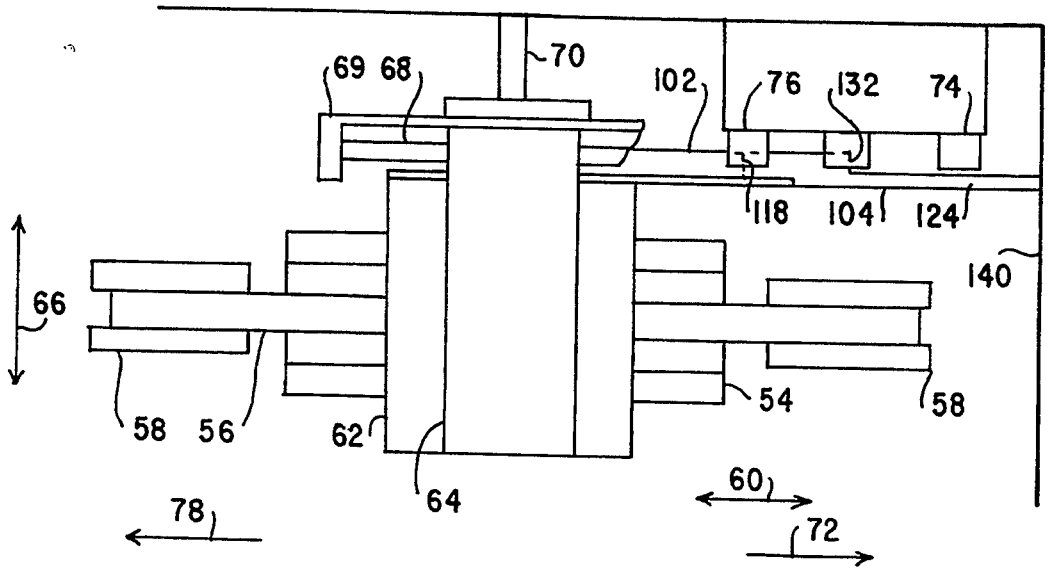
FIG. 10*b* is the view of FIG. 10*a* with the second tripping member initially engaging the sewing machine.
Figure 10C:
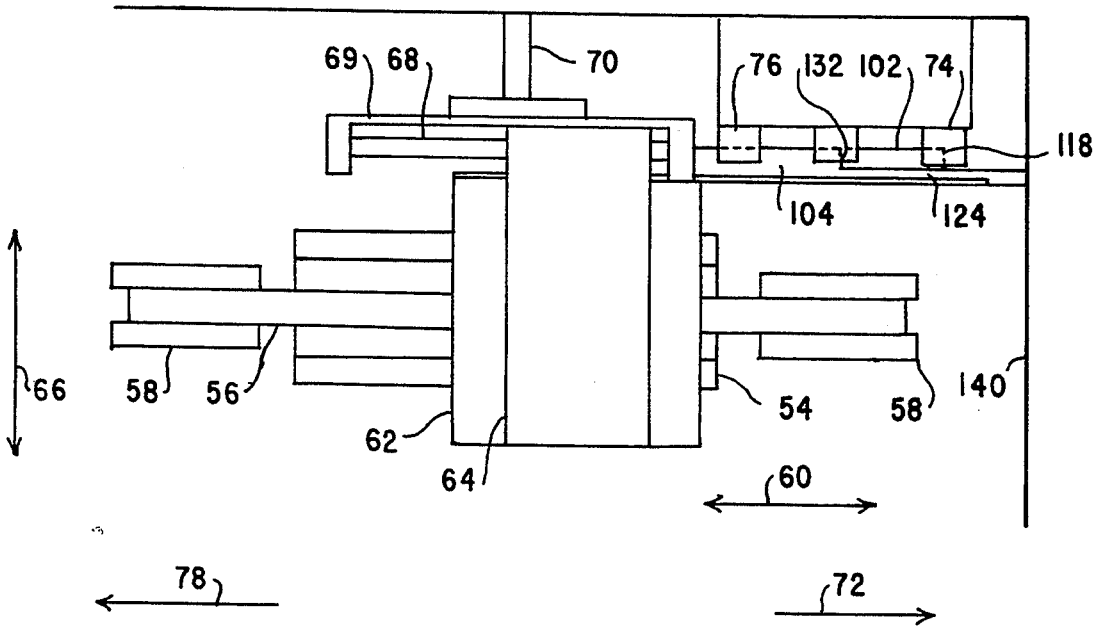
FIG. 10*c* is the view of FIG. 10*a* with the second tripping member fully engaged with the sewing machine and the first tripping member extending beyond the second tripping member to trip the first limit switch.

Referring now to FIGS. 10*a*–10*c*, there is shown a top view of an x-y table assembly 50 utilizing a tripping assembly 100 of the present invention. The tripping assembly 100 is mounted to the race table 62 in a manner similar to the tripping plate 52 of the prior art. As can be seen in FIG. 10*a*, the extending portion 124 of the second member 104 is misaligned with the limit switches 74, 76. That is, it does not fall within the tripping zone of the assembly and, therefore, it cannot trip either of the limit switches 74, 76. The first and second tripping edges 118, 132, on the other hand, are aligned with the limit switches 74, 76 (fall within the tripping zone) and will trip the limit switches 74, 76 if properly positioned. For example, if the race table 62 moves in the negative x direction 78 such that the second tripping edge 132 reaches the second limit switch 76, the body portion 122 of the second tripping member 104 will no longer block (e.g., the limit switch 76 opens) the second limit switch 76, as shown in FIG. 10*a*. As a result, the second limit switch 76 will be tripped, thereby sending a signal to the motor controller (now shown), and the race table 62 will be prevented from moving further in the negative x direction 78. As can be appreciated, the range of motion in the negative x direction 78 can be altered by changing the positioning of the second tripping edge 132 relative to the race table 62. For example, if the second tripping edge 132 is extended further in the positive x direction 72 relative to the race table 62, the race table 62 will be allowed to travel further in the negative x direction 78. Correspondingly, positioning the second tripping edge 132 closer to the race table 62 will result in the race table 62 having a smaller range of motion in the negative x direction 78.

As the race table 62 moves in the positive x direction 72, the extending portion 124 of the second member 104 will eventually engage the side wall 140 of the sewing machine 20, as shown in FIG. 10*b*. The interaction between the second member (104) and the side wall (140) of the sewing machine (20) provides a moving assembly for providing relative movement between the first member (102) and the second member (104). At this point, the second member 104 is prevented from moving further in the positive x direction 72. However, the first member 102 can continue to move in the positive x direction 72 by merely overcoming the force of the spring 106 (not shown in FIGS. 10*a*–10*c* for clarity). As the first member 102 continues to move in the positive x direction 72, the spring 106 will be extended and the first tripping edge 118 will eventually pass and extend beyond the second tripping edge 132 in the positive x direction 72.

Further movement of the first member 102 in the positive x direction 72 will eventually result in the first tripping edge 118 engaging and tripping (e.g., the limit switch 74 closes) the first limit switch 74, as shown in FIG. 10*c*, thereby preventing further movement of the race table 62 in the positive x direction 72. It can be seen, therefore, that the second tripping edge 132 is prevented from tripping the first limit switch 74. It should be appreciated that the range of movement of the race table 62 in the positive x direction 72 can be modified by changing the placement of the first tripping edge 118 relative to the race table 62. For example, providing a tripping assembly 100 with a first tripping edge 118 that extends further in the positive x direction 72 relative to the race table 62 will result in a smaller range of motion of the race table 62 in the positive x direction 72. Correspondingly, providing a tripping assembly 100 with a first tripping edge 118 that extends a shorter distance in the positive x direction 72 will result in a larger range of motion of the race table 62 in the positive x direction 72.

As a result of utilizing the tripping assembly 100 of the present invention, the range of motion in the positive and negative x directions 72, 78 is effectively increased. More specifically, the range of motion along the x axis 60 in both directions is increased by an amount approximately equal to the distance between the first tripping edge 118 and the second tripping edge 132. Accordingly, the range of motion along the x axis 60 of a programmable sewing machine 20 can be substantially increased without the need for changing the location of limit switches 74, 76 on the machine 20. Furthermore, the amount of the increase of motion allocated to the positive and negative x directions 72, 78 can be modified by changing the placement of the first and second tripping edges 118, 132 relative to the race table 62.

The foregoing description of the present invention has been presented for purposes of illustration and description. Furthermore, the description is not intended to limit the invention to the form disclosed herein. Consequently, variations and modifications commensurate with the above teachings, and the skill and knowledge of the relevant art, are within the scope of the present invention. The embodiments described hereinabove are further intended to explain best modes known of practicing the invention and to enable others skilled in the art to utilize the invention in such, or other, embodiments and with the various modifications required by the particular applications or uses of the invention. It is intended that the appended claims be construed to include alternative embodiments to the extent permitted by the prior art.

What is claimed is:

1. A sewing machine for stitching a pattern on a stitchable material, comprising:

a clamp assembly for engaging the stitchable material;

means for moving said clamp assembly along an axis in both first and second directions, said first direction being opposite said second direction;

first and second limit switches mounted on said sewing machine for limiting a range of movement of said clamp assembly in said first and second directions, respectively;

a tripping assembly interconnected and movable with said clamp assembly and comprising first and second tripping members movable relative to each other for tripping said first and second limit switches, respectively, wherein a tripping portion of said second tripping member is extendable beyond a tripping portion of said first tripping member in said first direction; and a moving assembly for moving said second tripping member relative to said first tripping member to thereby prevent said second tripping member from tripping said first limit switch as said clamp assembly and said tripping assembly move in said first direction.

2. A sewing machine, as claimed in claim 1, wherein: said moving assembly comprises an engaging portion of said second member which engages a portion of said sewing machine as said clamp assembly and said tripping assembly move in said first direction to thereby inhibit movement of said second tripping member in said first direction while said first tripping member continues to move with said clamp assembly in said first direction until tripping said first limit switch.

3. A sewing machine, as claimed in claim 2, wherein: said engaging portion of said second tripping member extends in said first direction to engage said portion of said sewing machine, said engaging portion being positioned such that it is misaligned with and thereby does not trip said limit switches.

4. A sewing machine, as claimed in claim 1, wherein: said second tripping member is in a first position relative to said first tripping member when said tripping assembly is tripping said second limit switch, said first position corresponding with said tripping portion of said second tripping member extending beyond said tripping portion of said first tripping member in said first direction.

5. A sewing machine, as claimed in claim 1, wherein: said second tripping member is in a second position relative to said first tripping member when said tripping assembly is tripping said first limit switch, said second position corresponding with said tripping portion of said first tripping member extending beyond said tripping portion of said second tripping member in said first direction.

6. A sewing machine, as claimed in claim 4, wherein: said tripping assembly further includes a biasing means for biasing said second tripping member in said first position.

7. A sewing machine, as claimed in claim 6, wherein said biasing means comprises a spring.

8. A sewing machine, as claimed in claim 7, wherein said spring is extended by said movement of said second tripping member relative to said first tripping member during movement of said clamp assembly and said tripping assembly in said first direction.

9. A sewing machine, as claimed in claim 1, wherein said second tripping member is slidably connected to said first tripping member.

10. An apparatus for increasing the range of movement of a clamp assembly of a sewing machine in a first direction and a second direction opposite the first direction, said apparatus comprising:

a first tripping member interconnectable and movable with the clamp assembly of the sewing machine, said first tripping member having a first tripping portion which is engageable with a first limit switch of the sewing machine, wherein a tripping zone is defined extending from said first tripping portion in said first direction;

a second tripping member interconnected with said first tripping member and movable relative to said first tripping member between first and second positions by engagement with at least a portion of the sewing machine, said second tripping member having a second tripping portion which is engageable with a second limit switch of the sewing machine, wherein said first position corresponds with said second tripping portion being positioned within said tripping zone, and wherein said second position corresponds with said second tripping portion being positioned out of said tripping zone.

11. An apparatus, as claimed in claim 10, wherein said tripping assembly further includes means for biasing said second tripping member in said first position.

12. An apparatus, as claimed in claim 10, wherein said biasing means comprises a spring.

13. An apparatus, as claimed in claim 12, wherein said spring is extended by said movement of said second tripping member relative to said first tripping member as said clamp and tripping assemblies move in said first direction.

14. An apparatus, as claimed in claim 10, wherein said second tripping member is slidably connected to said first tripping member.

15. A method of defining a range of movement of a clamp assembly of a sewing machine along an axis, said sewing machine further comprising a first limit switch for limiting movement of said clamp assembly in a first direction along said axis and a tripping assembly comprising first and second tripping members, said first tripping member being rigidly interconnected with said clamp assembly and said second tripping member being movably interconnected with said first tripping member, said second tripping member extending beyond said first tripping member in said first direction when in a first position, said method comprising the steps of:

moving said clamp assembly in said first direction;

moving said second tripping member relative to said first tripping member to a second position to prevent said second tripping member from tripping said first limit switch; and tripping said first limit switch with said first tripping member.

16. A method, as claimed in claim 15, wherein:

said moving said second tripping member step comprises inhibiting movement of said second tripping member in said first direction during at least a portion of said moving said clamp assembly step while generally allowing movement of said first tripping member in said first direction.

17. A method, as claimed in claim 15, wherein:

said moving said second tripping member step is performed during at least a portion of said moving said clamp assembly step.

18. A method, as claimed in claim 15, wherein:

said moving said second tripping member step is initiated during said moving said clamp assembly step and continues until said tripping step.

19. A method, as claimed in claim 15, wherein:

said moving said second tripping member step comprises axially moving said second tripping member in a second direction relative to said first tripping member and opposite said first direction.

20. A method, as claimed in claim 15, further comprising the step of:

biasing said second tripping member in said first position.

21. A method, as claimed in claim 15, further comprising the steps of:

moving said clamp assembly in a second direction opposite said first direction;

moving said second tripping member relative to said first tripping member to said first position to prevent said first tripping member from tripping said second limit switch; and tripping said second limit switch with said second tripping member.

22. A method, as claimed in claim 21, wherein:

said moving said second tripping member back to said first position step is performed during at least a portion of said moving said clamp assembly in a second direction step.

23. A method, as claimed in claim 21, wherein said moving said second tripping member back to first position step comprises axially moving said second tripping member in said first direction relative to said first tripping member.

* * * * *